US010827255B2

(12) United States Patent
Gu

(10) Patent No.: US 10,827,255 B2
(45) **Date of Patent: *Nov. 3, 2020**

(54) RECEIVER MODULE

(71) Applicant: AAC Technologies Pte. Ltd., Singapore (SG)

(72) Inventor: Xiaojiang Gu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 16/529,827

(22) Filed: Aug. 2, 2019

(65) Prior Publication Data

US 2020/0053453 A1 Feb. 13, 2020

(30) Foreign Application Priority Data

Aug. 10, 2018 (CN) ..... 2018 2 129405 U

(51) Int. Cl.

| | |
|---|---|
| ***H04R 1/28*** | (2006.01) |
| ***H04R 1/04*** | (2006.01) |
| ***H04R 9/02*** | (2006.01) |
| ***H04R 9/06*** | (2006.01) |

(52) U.S. Cl.

CPC ..... *H04R 1/2888* (2013.01); *H04R 1/04* (2013.01); *H04R 9/025* (2013.01); *H04R 9/06* (2013.01); *H04R 2410/05* (2013.01)

(58) Field of Classification Search

CPC ..... H04R 1/2888; H04R 1/04; H04R 9/025; H04R 9/06; H04R 2410/05; H04R 1/2807; H04R 1/2823; H04R 1/2846

USPC ..... 381/94.1, 354

See application file for complete search history.

(56) References Cited

U.S. PATENT DOCUMENTS

| | | | | |
|---|---|---|---|---|
| 2009/0245565 | A1* | 10/2009 | Mittleman | H04R 1/025 381/365 |
| 2015/0358708 | A1* | 12/2015 | Axelsson | H04R 1/1083 381/71.7 |
| 2016/0088385 | A1* | 3/2016 | Fan | B29B 11/14 381/352 |

* cited by examiner

*Primary Examiner* — Vivian C Chin
*Assistant Examiner* — Douglas J Suthers
(74) *Attorney, Agent, or Firm* — W&G Law Group LLP

(57) ABSTRACT

The present invention provides a receiver module, including: a receiver having a frame with a body part, a vibration system and a front cover overlaid on the frame. The front cover includes a sound outlet, an extension part extending from the body part, and a through hole penetrating the extension part. The receiver module further includes a denoising part, a sound absorbing hole penetrating the denoising part away from the vibration system, and a microphone set on a surface of the denoising part away from one side of the vibration system. Sound waves of the front chamber is exported to a back of sound absorbing hole away from the denoising part and noise is absorbed and eliminated by the microphone.

6 Claims, 2 Drawing Sheets

RECEIVER MODULE

FIELD OF THE PRESENT DISCLOSURE

The embodiments of the invention relate to the electroacoustic components, in particular to a receiver module used in a portable device.

DESCRIPTION OF RELATED ART

With the arrival of mobile internet era, the number of intelligent mobile devices is on the increase. While among so many mobile devices, mobile phone is undoubtedly the most common and portable mobile device. Currently, the functions of mobile phones are extremely diverse, one of which is the high-quality music function. Therefore, the receiver module used to play voice has been widely used in today's smart mobile devices.

The receiver module of the related technology includes a frame, a vibration system fixed on the frame and a front cover which is overlaid on the frame and encloses the front cavity with the vibration system. The front cover comprises a body part covered on the frame and a sound outlet running through the body part and connected with the front chamber.

However, in the receiver module of the related technology, the receiver module does not have the denoising (noise-cancelling) function. For example, when it is used as a receiver or speaker in a mobile phone, the communication quality will be affected by noise.

Therefore, it is necessary to provide an improved receiver module to solve the above technical problems.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

Figure 1:
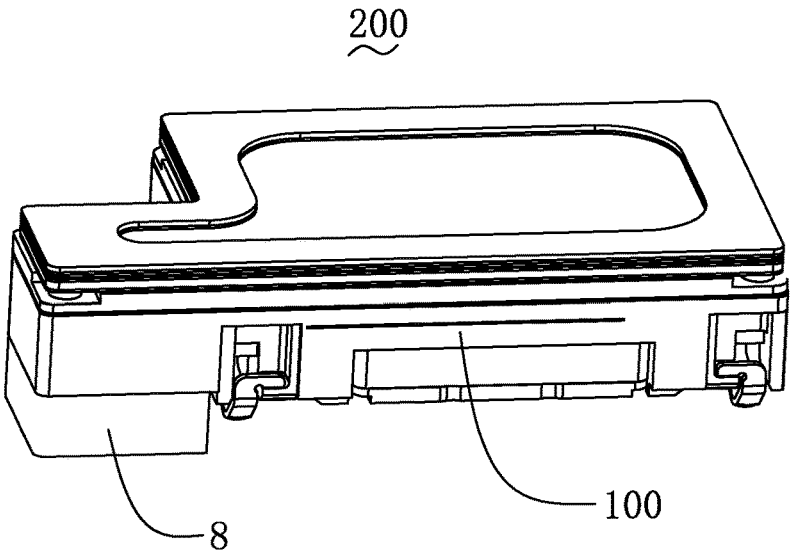
FIG. 1 is an isometric view of a receiver module in accordance with an exemplary embodiment of the invention.
Figure 2:
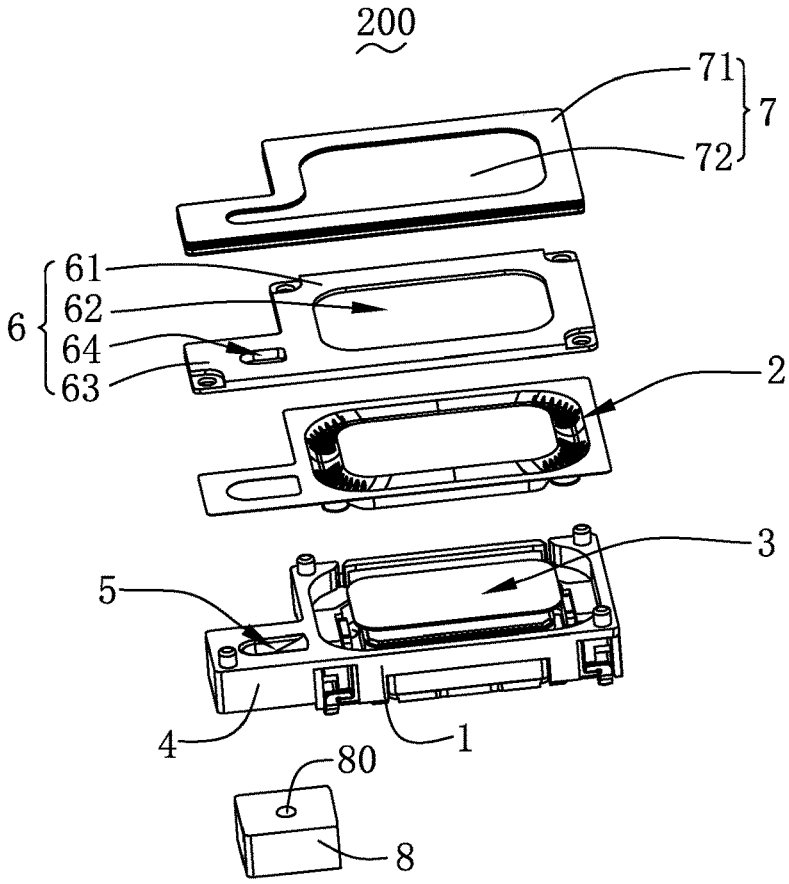
FIG. 2 an isometric and partially exploded view of the receiver module in FIG. 1.

The present disclosure will hereinafter be described in detail with reference to exemplary embodiment. To make the technical problems to be solved, technical solutions and beneficial effects of the present disclosure more apparent, the present disclosure is described in further detail together with the figures and the embodiment. It should be understood the specific embodiment described hereby are only to explain the disclosure, not intended to limit the disclosure.

Referring to FIGS. 1-4, the present disclosure provides a receiver module 200, which comprises a receiver 100 and a microphone 8. The receiver 100 comprises a frame 1, a vibration system 2, a magnetic circuit system 3, a denoising (noise-cancelling) part 4, a sound absorbing hole 5 and a front cover 6. The microphone 8 is provided with a sound inlet 80.

In the embodiment, a rectangular frame 1 is taken as the example for description. Of course, the frame 1 can be circular or in any other shape without limitation.

The vibration system 2 and the magnetic circuit system 3 are respectively fixed on the frame 1, and the magnetic circuit system 3 is used for driving the vibration system 2 to vibrate to radiate sound. A rear chamber (unlabeled) is jointly enclosed by the frame 1, the vibration system 2 and the magnetic circuit system 3 to improve the low-frequency acoustics performance of the receiver module 200.

The denoising part 4 is formed by extending outward from the circumference of the frame 1, such as extending outward from the short axis edge of the frame 1.

Figure 3:
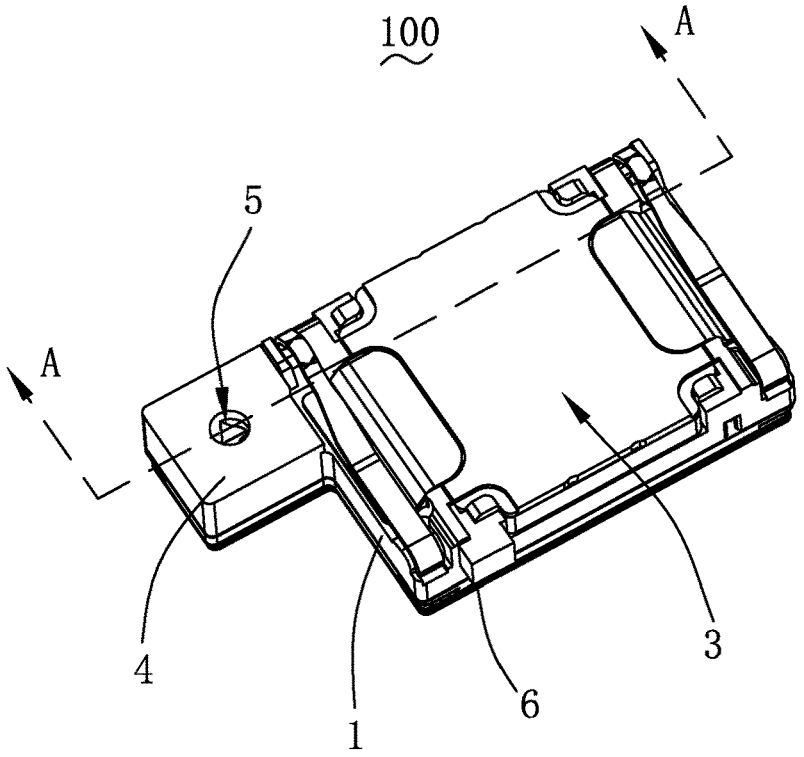
FIG. 3 is an isometric view of a receiver used in the receiver module.
Figure 4:
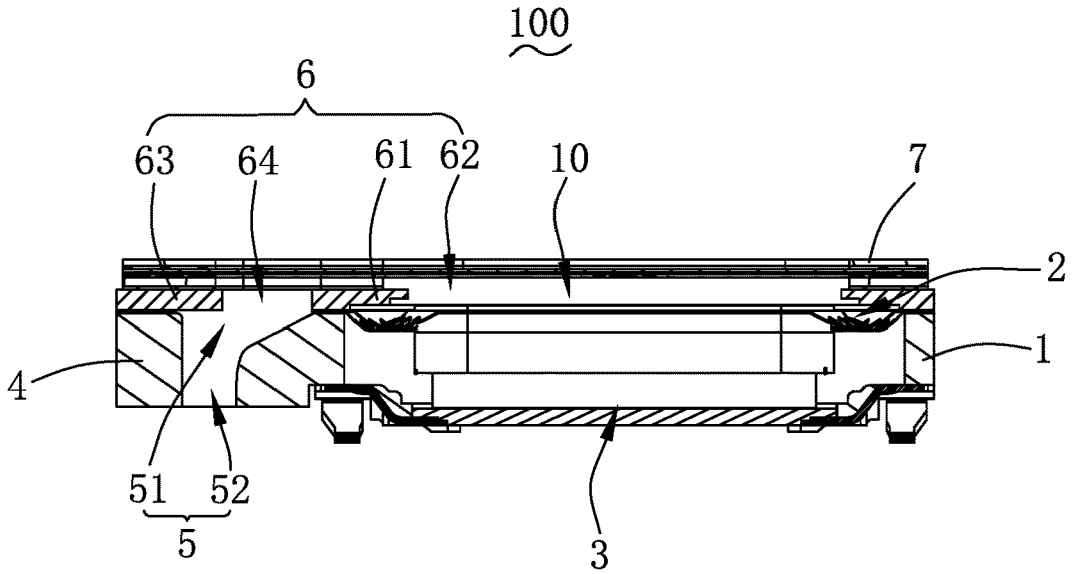
FIG. 4 is a cross-sectional view, taken along line A-A in FIG. 3.

In conjunction with FIG. 3, the sound absorbing hole 5 is set by running through the denoising part 4. The microphone is arranged on a surface of one side of the denoising part 4 far from the vibration system 2. The sound absorbing hole 5 is used as the sound inlet channel structure of the microphone.

The front cover 6 is arranged on the frame 1, and a front chamber 10 is enclosed by the front cover 6 and the vibration system 2 together.

Specifically, the front cover 6 comprises a body part 61 covered on the frame 1, a sound outlet 62 set through the body part 61, an extension part 63 extended from the body part 61, and a through hole 64 set through the extension part 63.

The sound outlet 62 is communicated with the front chamber 10 to sound.

The extension part 63 is arranged at the denoising part 4, and the front chamber 10, the through hole 64 and the sound absorbing hole 5 are connected in turn. The sound wave of the front chamber 10 is exported from the through hole 64 and the sound absorbing hole 5 to the back side of denoising part 4 far from the front chamber 10 to absorb and eliminate noise through the microphone. The back side of the embodiment is the lower side of FIG. 3, that is, the side of the denoising part 4 away from the extension part 63. Preferably, the cross-sectional area of the sound absorbing hole 5 closing to the end of the extension part 63 is larger than that of the end of the extension part 63, and the structure has a larger area of absorbing conversation noise for providing better acoustic performance.

Preferably, the sound absorbing hole 5 comprises a first section 51 closing to the extension part 63 and a second section 52 extending from the first section 51. The cross-sectional area of the first section 51 gradually decreases from one end closing to the extension part 63 to the direction of the second section 52 to be equal to the cross-sectional area of the second section 52.

In the present embodiment, the sound absorption hole 5 extends from one side of denoising part 4 closing to extension part 63 along the vibration direction of vibration system 2. The microphone is set on one side of denoising part 4 far away from extension part 63. The structure can make the microphone absorb telephone conversation noise from the front side of receiver 100 to make the denoising effect better to improve the acoustic performance of receiver module 200. Specifically, the sound-absorption hole 5 is round through hole.

When the receiver module 200 is used, for example, as a receiver or receiver, the sound wave of the conversation enters the through hole 64 from the front chamber 10, then enters the sound absorbing hole 5 from the through hole 64, and transmits from the sound absorption hole 5 and the sound inlet 80 to the microphone 8. The noise of the communication is absorbed by the microphone. The acoustic performance of the receiver module 200 is improved effectively to improve communication quality.

In this embodiment, the receiver 100 also includes a permeable isolation assembly 7 fixed on the front cover 6. The permeable isolation s assembly 7 completely overlays the sound outlet 62 and the through hole 64, and connects the sound outlet 62 and the through hole 64 with the outside world respectively.

The so-called permeable isolation assembly 7 is capable of allowing gas (air) to flow through but preventing solid materials to enter inside, after the permeable isolation assembly 7 overlays the sound outlet 62 and the through hole 64. On the one hand, the sound outlet 62 and the through hole 64 can be ventilated normally with the outside air. On the other hand, the foreign body can be prevented from entering to avoid causing pollution and blockage. The reliability of the receiver 100 is improved.

Specifically, the permeable isolation assembly 7 comprises a ring-shaped frame 71 fixed on the front cover 6 and a permeable membrane 72 attached on the frame 71. The permeable membrane 72 fully covers the sound outlet 62 and the through hole 64. The frame 71 improves the fixed stability of the permeable isolation assembly 7.

In the present embodiment, the permeable isolation assembly 7 is attached on one side of the front cover 6 far from the vibration system 2, which does not occupy the space of the front chamber 10, so that the vibration system 2 has sufficient vibration space.

Compared with related technologies, the receiver module of the present disclosure extends around the periphery of the frame to form the denoising part, and the sound absorbing hole penetrating denoising part is set on denoising part and. At the same time, the front cover is designed to have the body part covering the frame, the extension part extending from the body part and a through hole through the extension part. The extension part is overlaid on denoising part to connect through hole with sound absorbing hole. In addition, the microphone is installed and set in the sound-absorbing hole. Sound wave enters through the through hole and sends to the microphone from sound absorbing hole to make the microphone absorb the noise of telephone conversation to improve the acoustic performance of receiver module.

It is to be understood, however, that even though numerous characteristics and advantages of the present exemplary embodiment have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A receiver module, including:

a receiver, the receiver comprising a frame with a body part, a vibration system fixed on the frame and a front cover overlaid on the frame and enclosing with the vibration system to form a front chamber; the front cover comprising:

a sound outlet penetrating the body part of the frame and communicating with the front chamber;

an extension part extending from the body part;

a through hole penetrating the extension part;

a denoising part extending outward from a periphery of the frame;

a sound absorbing hole penetrating the denoising part away from the vibration system;

a microphone set on a surface of the denoising part away from one side of the vibration system;

wherein the extension part is overlaid on the denoising part, and connects the front chamber, the through hole, the sound absorbing hole and a sound inlet of the microphone sequentially;

wherein sound waves of the front chamber are exported to a back of sound absorbing hole away from the denoising part such that noise is absorbed and thereby eliminated from by the microphone.

2. The receiver module as described in claim 1, wherein the sound absorbing hole extends along a vibration direction of the vibration system from one side of the denoising part closing to the extension part, and the microphone is set on one side of the denoising part far from the extension part.

3. The receiver module as described in claim 1, wherein a cross-sectional area of the sound absorbing hole closing to one end of the extension is larger than that far from the same end of the extension part.

4. The receiver module as described in claim 1, wherein the sound absorbing hole comprises a first section close to the extension part and a second section extending from the first section; and a cross-sectional area of the first section is gradually reduced from one end close to the extension part along a direction toward the second section.

5. The receiver module as described in claim 1 further including a permeable isolation assembly fixed on the front cover; wherein the permeable isolation assembly completely overlays the sound outlet and the through hole and communicates the sound outlet and the through hole with an outside of the receiver module.

6. The receiver module as described in claim 5, wherein the permeable isolation assembly comprises a ring-shaped frame fixed on the front cover and a permeable membrane attached on the frame, the permeable membrane completely overlays the sound outlet and through hole.

* * * * *